US005602739A

United States Patent [19]

Haagenstad et al.

[11] Patent Number: 5,602,739

[45] Date of Patent: Feb. 11, 1997

[54] VEHICLE TRACKING SYSTEM INCORPORATING TRAFFIC SIGNAL PREEMPTION

[75] Inventors: Jeffrey D. Haagenstad, Roseville; Steven M. Hamer, Willernie; Ronald A. Hagen, Grant Township; Edmund J. Ring, Circle Pines; Kim K. Christopher, Woodbury; Theodore B. Keyes, St. Paul, all of Minn.

[73] Assignee: Minnesota Mining and Manufacturing Company, St. Paul, Minn.

[21] Appl. No.: 562,352

[22] Filed: Nov. 22, 1995

Related U.S. Application Data

[63] Continuation of Ser. No. 73,880, Jun. 9, 1993, abandoned.

[51] Int. Cl.[6] ..... G08G 1/07

[52] U.S. Cl. ..... 364/436; 364/449.1; 340/906; 340/989; 342/456; 342/457

[58] Field of Search ..... 364/436, 443, 364/446, 449; 340/988, 989, 994, 906, 907; 342/357, 450, 454, 456, 457

[56] References Cited

U.S. PATENT DOCUMENTS

| | | | |
|---|---|---|---|
| D. 316,153 | 4/1991 | Lyons | D26/28 |
| D. 338,165 | 8/1993 | Gregori et al. | D10/104 |
| 2,355,607 | 3/1940 | Shepherd | 177/337 |
| 3,550,078 | 3/1967 | Long | 340/32 |
| 3,568,161 | 3/1971 | Knickel | 340/992 |
| 3,831,039 | 8/1974 | Henschel | 307/234 |

(List continued on next page.)

FOREIGN PATENT DOCUMENTS

| | | |
|---|---|---|
| 0197539 | 10/1986 | European Pat. Off. . |
| 0467377 | 1/1992 | European Pat. Off. . |
| 2444984 | 7/1980 | France . |
| 3440657 | 5/1986 | Germany . |
| 2188464 | 9/1987 | United Kingdom . |
| WO89/05255 | 6/1989 | WIPO . |

OTHER PUBLICATIONS

Motorola, Automatic Vehicle Location System Brochure, 1986.

Marrow, Inc., Vehicle Tracking Brochure, 1987.

Etak Emergency Response System Brochure No Date.

Etak, Inc. Product Brochures, 1986.

Accqpoint, Low–Cost Nationwide Real–Time Differential GPS Product Brochure, 1993.

(List continued on next page.)

*Primary Examiner*—Collin W. Park

*Attorney, Agent, or Firm*—Gary L. Griswold; Walter N. Kirn; Kari H. Bartingale

[57] ABSTRACT

An embedded system controller-based vehicle tracking system using vehicle positioning. An embedded system controller controls a traffic intersection using an optical system. The embedded system controller receives a vehicle location and a vehicle schedule. The embedded system controller calculates whether the vehicle is on time and reports the on-time status to the driver interface. The driver may -request that the system report a panic or emergency situation to the dispatch center through an external data communications network. The external data communications network may also send vehicle status, such as vehicle position and vehicle condition. A transit company using the system may provide vehicles equipped with the vehicle tracking system with schedules on a daily basis, using a portable data transfer device. The embedded system controller also communicates to the vehicle data network for the communication of vehicle position. A global positioning system receiver may be used to provide the position of the vehicle to the embedded system controller.

12 Claims, 13 Drawing Sheets

U.S. PATENT DOCUMENTS

| | | | |
|---|---|---|---|
| 3,886,515 | 5/1975 | Cottin et al. | 340/23 |
| 4,015,804 | 4/1977 | Dobler et al. | 246/5 |
| 4,092,718 | 5/1978 | Wendt | 364/436 |
| 4,162,477 | 7/1979 | Munkberg | 340/32 |
| 4,212,069 | 7/1980 | Baumann | 364/467 |
| 4,230,992 | 10/1980 | Munkberg | 328/140 |
| 4,234,967 | 11/1980 | Henschel | 455/603 |
| 4,360,875 | 11/1982 | Behnke | 364/436 |
| 4,443,783 | 4/1984 | Mitchell | 340/32 |
| 4,573,049 | 2/1986 | Obeck | 340/924 |
| 4,701,760 | 10/1987 | Raoux | 340/993 |
| 4,713,661 | 12/1987 | Boone et al. | 340/994 |
| 4,734,863 | 3/1988 | Honey et al. | 364/449 |
| 4,734,881 | 3/1988 | Klein et al. | 364/900 |
| 4,774,672 | 9/1988 | Tsunoda et al. | 364/449 |
| 4,791,571 | 12/1988 | Takahashi et al. | 364/436 |
| 4,799,162 | 1/1989 | Shinkawa et al. | 364/436 |
| 4,804,937 | 3/1989 | Barbiaux et al. | 340/52 F |
| 4,942,503 | 7/1990 | Lyons | 362/74 |
| 4,963,889 | 10/1990 | Hatch | 342/357 |
| 4,970,439 | 11/1990 | Stopa | 315/241 R |
| 4,972,185 | 11/1990 | Stopa et al. | 340/825.720 |
| 4,994,714 | 2/1991 | Hoekman et al. | 315/80 |
| 5,043,736 | 8/1991 | Darnell et al. | 342/357 |
| 5,068,656 | 11/1991 | Sutherland | 340/989 |
| 5,072,227 | 12/1991 | Hatch | 342/357 |
| 5,119,102 | 6/1992 | Barnard | 342/357 |
| 5,122,959 | 6/1992 | Nathanson et al. | 364/436 |
| 5,172,113 | 12/1992 | Hamer | 340/907 |
| 5,177,489 | 1/1993 | Hatch | 342/357 |
| 5,177,684 | 1/1993 | Harker et al. | 364/436 |
| 5,187,373 | 2/1993 | Gregori | 250/551 |
| 5,187,476 | 2/1993 | Hamer | 340/906 |
| 5,202,683 | 4/1993 | Hamer et al. | 340/906 |
| 5,243,529 | 9/1993 | Kashiwazaki | 364/449 |
| 5,365,449 | 11/1994 | Kashiwazaki | 364/449 |

OTHER PUBLICATIONS

Introducing Cabmate Computerized Taxi Dispatching System Brochure No Date.

Mobile Data International Inc., Winter 1985, vol. 1, No. 1.

Mobile Data International Inc., Spring 1987, vol. 1, No. 7.

Strobecom I, Traffic Preemption System, Tomar Electronics Inc. Brochure. No Date.

Strobecom I, Traffic Preemption System Specifications, Tomar Electronics Inc. Brochure. No Date.

Tomar Electronics Inc. Brochure. No Date.

Emergency Vehicle Priority Control System, Jun. 1993, pp. 1–6.

Ivan A. Getting, "The Global Positioning System", *IEEE Spectrum*, Dec. 1993, pp. 36–47.

Megadyne Information Systems, Softward Product Briefs, 1987.

Megadyne Information Systems, V–Trax Automated Vehicle Monitoring Information System, 1988, pp. 1–7.

Met, Inc., Automatic Vehicle Location Vehicle Management System Brochure. No Date.

Differential Corrections Inc. (DCI), Differential Correction Services Product Brochures. No Date.

Motorola, Automatic Vehicle Location System Brochure, 1985.

EMTrack Computer Aided Dispatch System Functional Specification, Automated Dispatch Services, Inc., pp. 1–24, Feb. 1993.

Automated Dispatch Services (A.D.S.) brochure. No date.

VEHICLE TRACKING SYSTEM INCORPORATING TRAFFIC SIGNAL PREEMPTION

This is a continuation of application Ser. No. 08/073,880 filed Jun. 9, 1993, now abandoned.

This invention relates to a method and apparatus for tracking vehicles and, more particularly, to a vehicle tracking system incorporating traffic signal priority preemption.

BACKGROUND OF THE INVENTION

Solving our nation's traffic problems continues to be one of the primary concerns of the United States Department of Transportation (DOT). The DOT's efforts to address these problems have focused on strategies to support an intelligent vehicle-highway system (IVHS) which attempts to reduce traffic congestion, reduce accidents, improve transit service, use less fuel, and improve the environment by reducing emissions. One important goal is to encourage the use of mass transit systems. IVHS development in the Advanced Public Transit System (APTS) area for bus transit is executed through the use of travel corridors in which operational tests are conducted to evaluate potential "smart bus" technologies, and to determine their effectiveness in real-world situations.

Public transit buses must generally follow a pre-determined schedule. The schedule is published and is relied upon by the riding public to gain access to the mass transit system. The transit company creates the schedule, which includes locations, routes, and times of arrival. At intersections, signal light controllers provide traffic control that allows the orderly progression of vehicles through the intersection. Some intersection systems are equipped with priority overrides that allow emergency vehicles to override the normal traffic control pattern. Also, these intersection systems often have a second level of priority that may be used by buses.

Currently buses leave the bus depot with their schedule for the day and operate largely without oversight for the duration of the shift. During the day the bus may be ahead of schedule or behind schedule, dependent on ridership, traffic conditions, weather, and other unforeseen events. Keeping buses on schedule is key to customer satisfaction and increased ridership.

There are currently systems that provide automatic vehicle location capabilities only. These systems cannot provide intersection signal preemption functions or other emergency response functions that are necessary to make a bus system popular with the public.

SUMMARY OF THE INVENTION

According to the present invention a vehicle tracking system includes a vehicle position identifying system and a controller. The position identifying system determines the vehicle's location and provides it to the controller. The controller compares the location information with schedule information and the real or elapsed time information and provides output indicating whether the vehicle is ahead of, behind or on schedule.

BRIEF DESCRIPTION OF THE DRAWINGS

To illustrate this invention, a preferred embodiment will be described herein with reference to the accompanying drawings.

DETAILED DESCRIPTION OF THE PREFERRED EMBODIMENT

Figure 1:
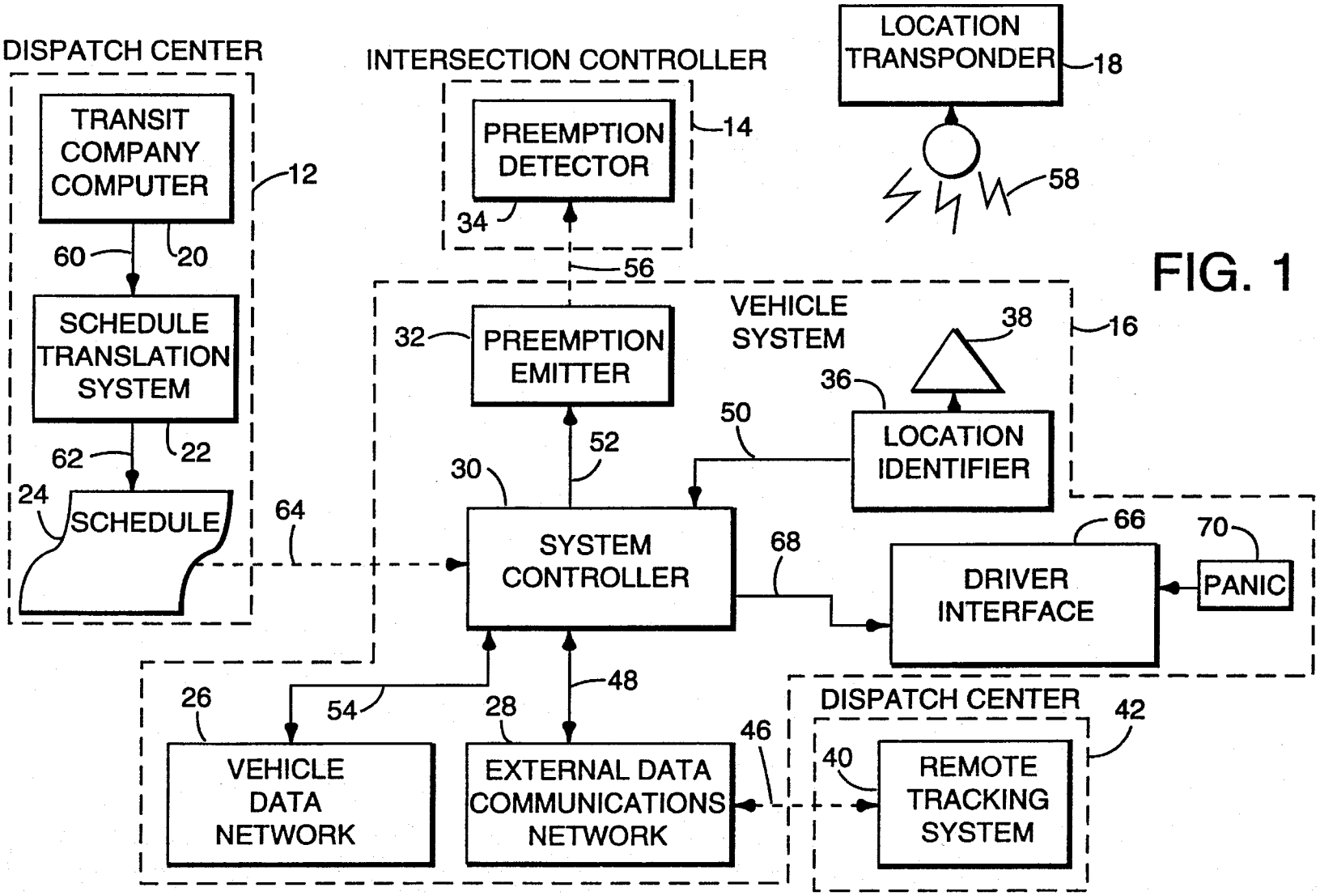
FIG. 1 shows a schematic block diagram of the vehicle tracking system of the invention.

FIG. 1 shows a schematic block diagram of the vehicle tracking system of the invention. The system includes an operations center 12, an intersection system 14, a vehicle system 16, and a dispatch center 42.

The operations center 12 has a transit company computer 20 and a schedule translation system 22. Transit company computer 20 may be any preexisting computer used by the company. Transit company computer 20 provides schedule data on signal line 60. Since the data is provided in the format used by the transit company's computer, which is not, in general, the same as the format used by the vehicle tracking system, it is called untranslated data. The schedule translation system 22 converts the untranslated schedule data into the format used by the vehicle tracking system and correlates the schedule data with a geographic information system database so that positional information waypoints may be extracted. The original untranslated data may include street and cross-street combinations, street addresses, or feature or building names. The translator 104 uses the geographic information system database to convert the specified locations into the corresponding latitude and longitude. The resulting translated schedule 24 includes route identifiers, route origins, route start times, stops defined as latitude and longitude combinations, and times that the transit vehicle is scheduled to visit each designated or controlled stop. The stop time may be defined as either an absolute time such as "12:24 PM," or as an offset from a reference time. Schedule 24 may also contain other information such as route configurations such as express or local. Once the schedules, routes, and waypoints are "translated," they may be transferred to the embedded system controller 30 on the vehicle. Schedule translation system 22 provides the converted schedule 24 on signal line 62.

The schedule is then communicated to the vehicle system 16 using schedule transfer apparatus 64. Preferably the schedule is loaded for each route using a portable data transfer device. Each portable data transfer device should have enough non-volatile memory to contain all the information pertaining to at least one route. The driver simply inserts the portable data transfer device that contains the information for the chosen route into the on-board controller. Given the route information, embedded system controller 30 automatically determines the applicable route and begins tracking the bus. The portable data transfer device allows any bus and any set of routes to be assigned to any driver at any time. This allows the invention to be included in a transit company's existing operations with minimal impact to work flow. Those skilled in the art will appreciate that a variety of devices such as Datakey data storage devices available from Datakey Incorporated of Minneapolis, Minn., PCMCIA cards, magnetic stripe cards, floppy diskettes, and other well known data transfer media may be employed as schedule transfer devices. In an alternative embodiment, the external data communications network 28 is used to receive the schedule. The schedule information generally includes latitudes, longitudes and arrival times.

The vehicle system 16 includes a vehicle data network 26 that is interfaced to embedded system controller 30 through a bi-directional vehicle network interface 54. Embedded system controller 30 aim communicates with a traffic signal preemption system. A vehicle location identifier 36 determines the vehicle's location at all times. Location identifier 36 may work in conjunction with a receiver 38. Location identifier 36 provides the location of the vehicle to system controller 30 on signal line 50. The external data communication network 28 communicates with embedded system controller 30 through a data communications bus 48. The external data communication network 28 communicates with the dispatch center 42 on a dispatch communication channel 46. A remote tracking system 40 may receive the vehicle tracking data by a cellular telephone data network or a private RF or microwave communication system. A driver interface provides output to the driver and allows the driver to provide input in return.

An important aspect of the invention is that much processing that could otherwise be performed on the transit company's computer is performed on-board the bus by vehicle system 16. This includes, among other things, determination of the vehicle's position and calculation of bus'status relative to the schedule. This greatly reduces the load on the communication system that would otherwise be required to transmit raw data rather than only the results of the calculations. Thus a simpler, and hence less expensive, external data communication system may be utilized. It also makes possible the use of a much less powerful computer system at the transit company's headquarters allowing the continued use of existing equipment.

Once the data has been transferred from the schedule transfer apparatus 64 to the embedded system controller 30, vehicle system 16 tracks the vehicle's progress. The vehicle's position may be determined in a number of manners. In most of these a signal 58 is sent from an external location transponder 18 to a location receiver 38 aboard the bus. In a preferred embodiment the Global Positioning System (GPS) is utilized. The GPS works by broadcasting high frequency signals from satellites. These signals are received on the ground and, from them, the position is calculated. These receivers, the construction of which are well known, are capable of calculating their position to within 100 meters anywhere on the globe. Other well known technologies may be used instead of the GPS system. Examples of these include location beacons that broadcast specific locations to a small-radius area through which the controlled vehicle passes, optical beacons that are similar to location beacons but use encoded infrared or visible light in place of RF, embedded inductive loops in the roadbed, Loran C, a ground based system similar to GPS, dead reckoning, or inertial tracking. Preferably a combination of these systems may be used. For example, a GPS receiver may provide the primary location information with a dead reckoning system providing location information when poor reception prevents the GPS system from functioning.

Embedded system controller 30 processes this location information and compares it to the schedule loaded by the driver to determine if the bus is late, early, or on-time, or if it has left the route. In addition, this location determining systems will indicate if a bus skips a stop. This is possible since the location of each stop is known. If a bus does not occupy that location at some time, the stop has been skipped.

Embedded system controller 30 tracks the bus' progress, as described above, monitors other aspects of the bus' operation, and communicates several pieces of information over external data communication network 28. The information transmitted may include the position, speed, and heading of the bus, information regarding whether the bus is behind, ahead of, or on schedule, information regarding the number of passengers on the bus, information about unusual circumstances such as whether the bus is off route, and information regarding emergency conditions. Such information may be transmitted periodically, upon request from the transit company's management center, or when preselected conditions arise warranting a transmission. Typically a combination of these reporting strategies will be used.

Should embedded system controller 30 detect an anomalous condition, action to be taken may include contacting the transit company management center and reporting the condition, attempting to analyze and correct the condition, or reporting the condition to the driver. For example, if the vehicle is behind schedule, the traffic signal preemption transmitter 32 may be activated in order to request green traffic lights for the bus. If the information is reported to the transit company's management center, the transit company will be able to take corrective action such as notifying the police of an emergency, quickly getting a repair crew to a broken-down bus, sending a new bus. Data reported over a period of time will permit other remedial action such as modifying the schedule, or dropping stops on routes that consistently run behind schedule.

The external data communications network 28 allows the transit company's management center 42 and the vehicle to establish a reliable, secure, one-to-one addressable link with each other to communicate status information or to change operational parameters. This network 28 could be a standard cellular data packet network, a spread-spectrum RF communications infrastructure, a trunked RF or microwave communications system, laser beam or optically based communication.

Vehicle data network 26 may also include other, optional, monitoring systems. For example, sensors could be attached to the bus' engine to give early indications of potential mechanical problems. In addition, data collected from fare collection boxes or other passenger counting systems could provide information on ridership.

A bus driver interface 66 provides the driver with current status information. Such information could include an indication of whether the bus is currently ahead, behind or on schedule, the number of passengers currently on the bus, and the mechanical status of the bus. A panic button 70 may be provided for use in the event of an emergency. When pressed panic button 70 causes the embedded system controller 30 to establish a connection 46 with the dispatch center 42 and provide current position, speed and heading information, allowing the bus to be quickly located, and appropriate response vehicles to be dispatched to the bus' location.

Figure 2:
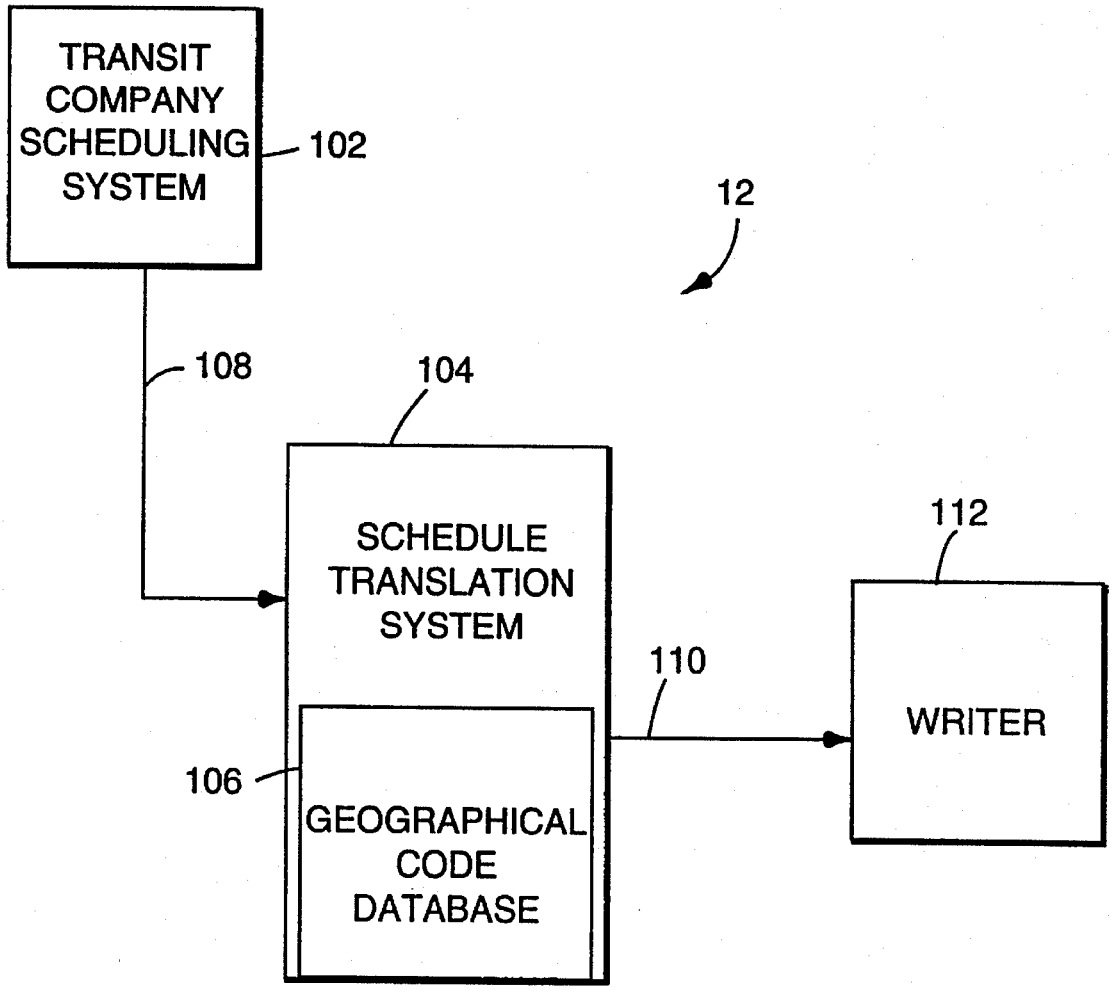
FIG. 2 shows the schedule translation system of the invention.

FIG. 2 shows schedule translation system 22. Schedule translation system 22 includes translation software 104 running on a computer, and a portable data transfer device writer 112. The translation software 104 translates the transit company's bus schedule into a format usable by the embedded system controller 30 of FIG. 1. Schedule translation includes converting the transit company's bus stop mnemonics into route locations, then adding latitude and longitude locations for the route locations from a geographic information system database. The geographic information system database may be commercially available or may be compiled specifically for use with the system of the invention. The schedule translation software 104 transmits the translated data to a portable data transfer device writer 112 to load the specially-formatted schedules into the portable data transfer devices. The portable data transfer devices are then used to transfer route schedules into the on-board embedded system controllers.

Figure 3:
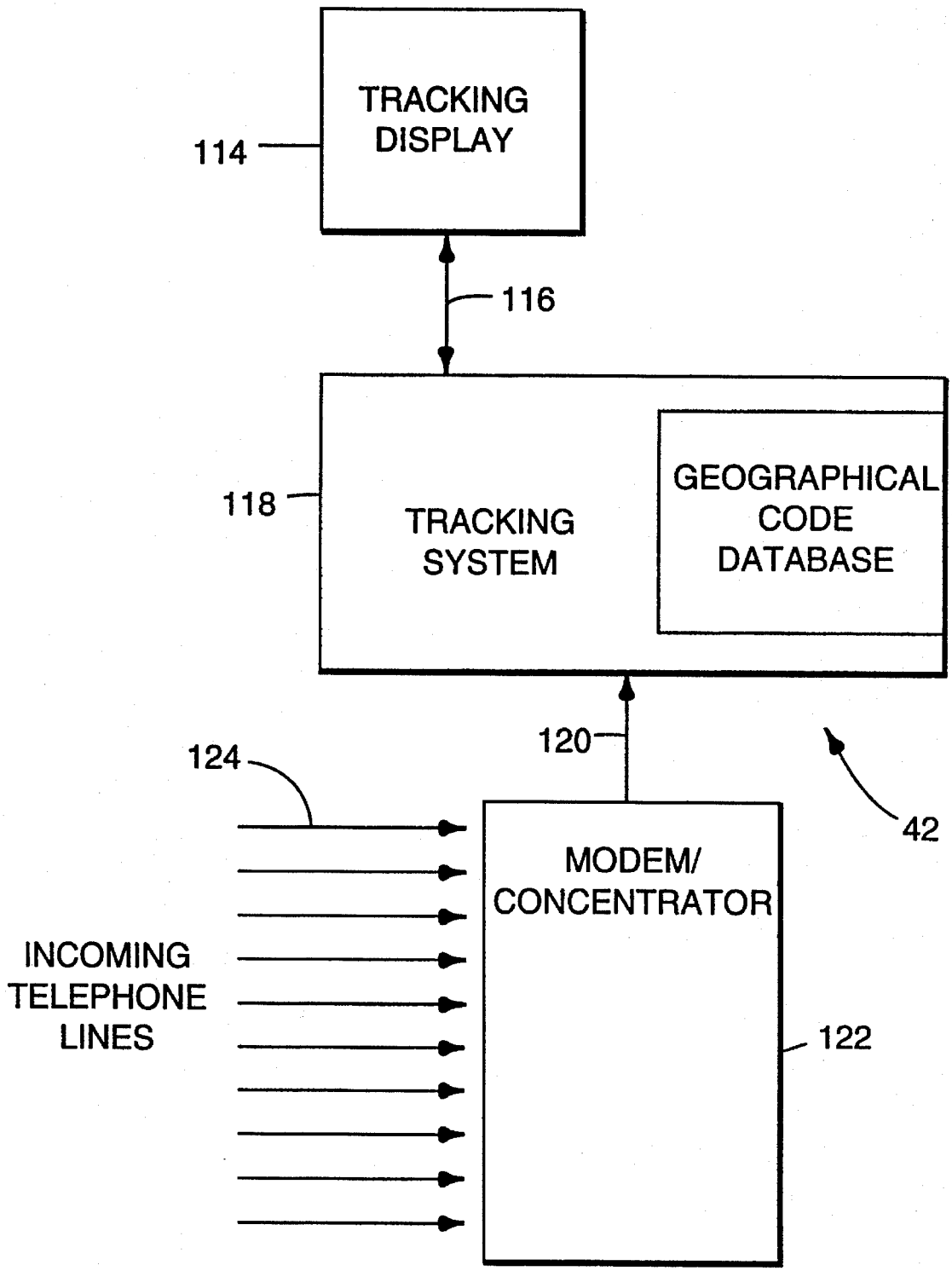
FIG. 3 shows the dispatch center system of the invention showing several incoming telephone lines through a modem concentrator.

FIG. 3 shows the dispatch center system comprising a multiport modem 122 and a computer running the tracking software 118. Modem 122 is connected to a plurality of telephone lines 104. Each of the telephone lines 104 will have the same phone number or a limited number of phone numbers. Exception-based transmissions regarding schedule status or emergency conditions from the bus' embedded system controller 30 are displayed on the tracking display 114 as they are received. Upon request, the invention allows the dispatch center personnel to quickly locate any bus employing the method of the invention. The tracking software accesses the geographic information system database to convert the bus' latitude and longitude position to a more user-readable street address, intersection, or feature name.

Figure 4:
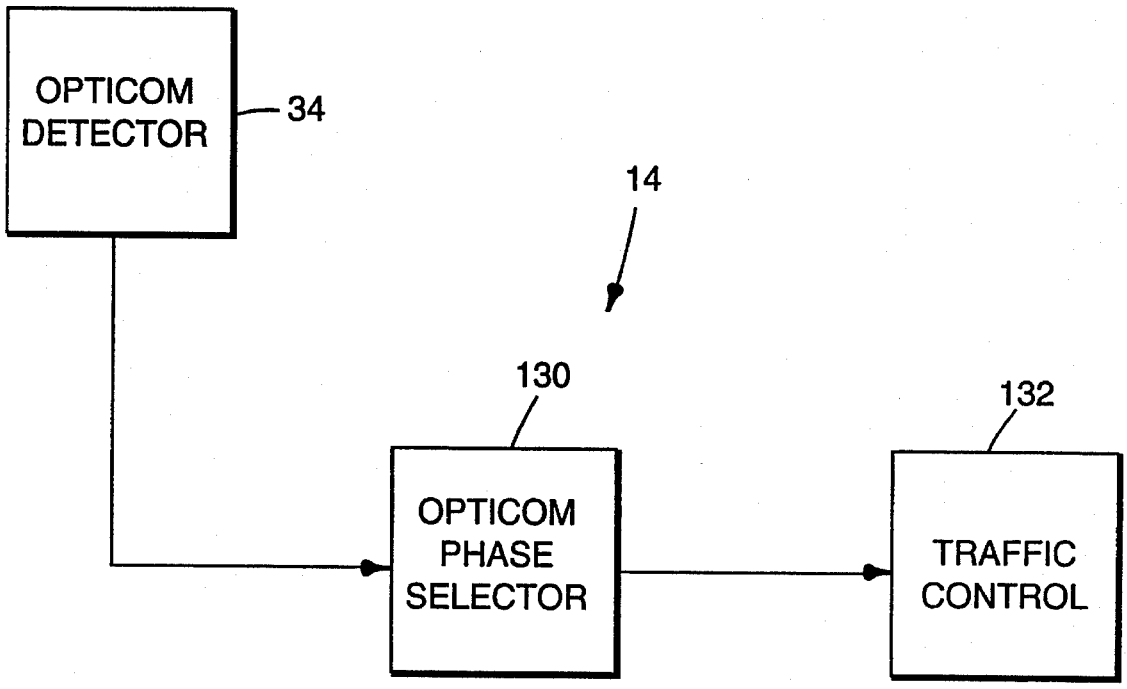
FIG. 4 shows the intersection control system used in one embodiment of the invention.

As previously described, when the bus is determined to be behind schedule, traffic signal preemption emitter 32 of FIG. 1 is activated to request green lights for the bus. Traffic signal preemption system emitter 32 works in conjunction with intersection system 14 shown in more detail in FIG. 4. Although various traffic signal preemption systems may be used, it is preferably an Opticom traffic signal preemption system available from the Minnesota Mining and Manufacturing Company of St. Paul, Minn.

The Opticom emitter 32 is a stroboscopic optical device that, in conjunction with an Opticom Detector 34, an Opticom Phase Selector 130, and a controlled intersection, allows a vehicle to gain "green light" priority at an intersection. In the case of a bus, this priority allows the vehicle to complete its route faster and more efficiently, or allows it to make up for lost time which prevents the vehicle from falling farther behind schedule.

The Opticom detector 34 receives the flashing pulses from the emitter 32 and passes a signal representative thereof to Opticom phase selector 130. If Opticom phase selector 130 detects a flash frequency that corresponds to the frequency of Opticom emitter 32 it requests the controlled intersection to give the green light in the Emitter's direction priority over all other directions.

The Opticom system uses two levels of priority to arbitrate which type of vehicle receives the green light. The higher level of priority is used by emergency vehicles such as police cars, fire trucks, or ambulances. The lower level priority is intended to be used by non-emergency vehicles to provide them with a priority over ordinary traffic. If the Opticom system has just granted a low priority request to a bus and subsequently receives a high-priority request from an emergency vehicle, the higher priority request preempts the lower priority request. The different priorities are distinguished by different frequencies of the stroboscopic signal. Opticom phase selector 130 makes a determination as to the priority level of the signal.

Figure 5:
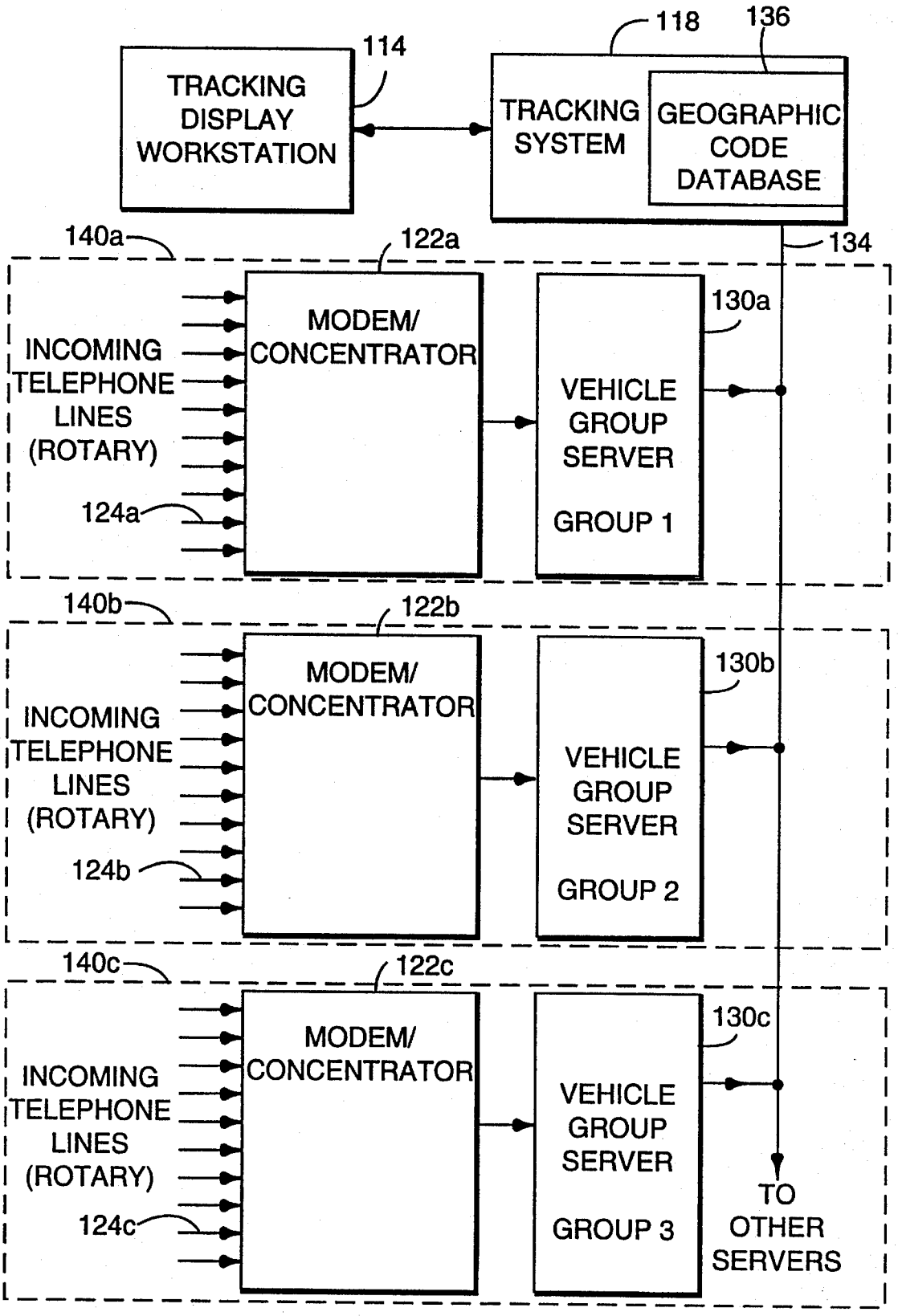
FIG. 5 shows a tracking system used in the method and apparatus of the invention.

FIG. 5 shows a tracking system used in the method and apparatus of the invention. The tracking display workstation 114 communicates to the tracking system 118 that is used to service the vehicle group servers. Group 1 **140*a* includes incoming telephone lines 124*a*, modem concentrator 122*a*, and vehicle group server 130*a*. Similarly, group 2 includes incoming telephone lines 124*b*, modem concentrator 122*b*, and vehicle group server 130*b*. There may be any reasonable number of groups as illustrated by group N comprising incoming telephone lines 124*c*, modem concentrator 122*c*, and vehicle group server 130*c*. As illustrated, each group server services a number of telephone lines. The vehicle group servers 130*a*, 130*b* and 130*c* are, in turn, managed by the tracking system 118**. Thus a large number of telephone lines may be provided in order to handle a worst-case scenario where many vehicles are attempting to transmit data to the tracking system at the same time. This might occur, for example, during a snow storm or other weather-related or natural-disaster related occurrence.

Figure 6:
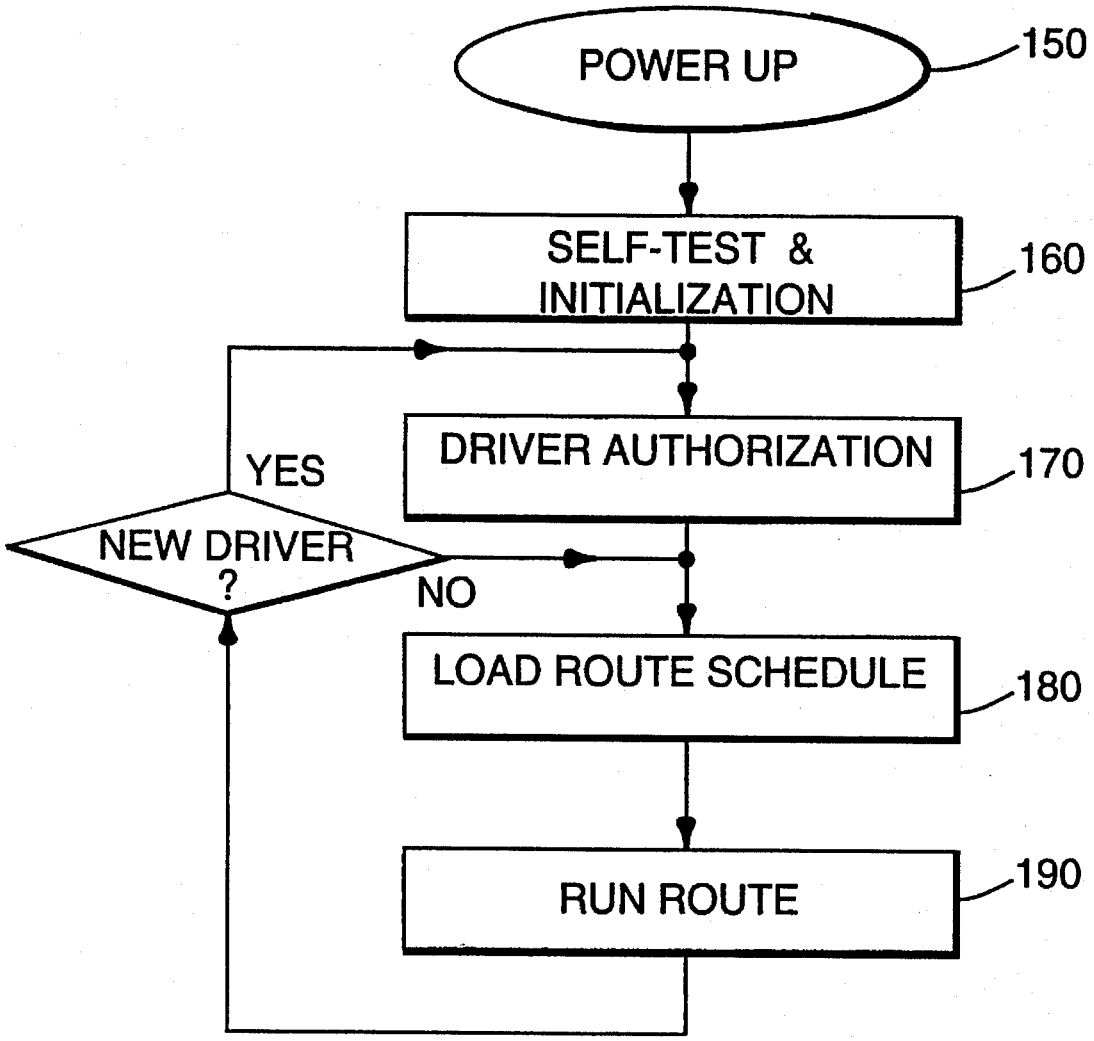
FIG. 6 shows an embedded controller monitor top level flow diagram as employed in accordance with the invention.

FIG. 6 shows the embedded controller monitor top level flow diagram. The embedded system controller 30 powers up in step 150. A self test and initialization is performed in step 160. In step 170 the embedded system controller 30 determines whether the driver is authorized. If the driver is authorized, the method of the invention loads the route schedule in step 180. If the route schedule is successfully loaded in step 180, the embedded system controller 30 runs the route in step 190. The monitor returns to step 180 if it is the same driver on a new route or it returns to step 170 to authorize a new driver if a new driver is to drive the bus containing the system. Each of these steps will be described in more detail below in the context of a particular preferred embodiment of the invention.

Figure 7:
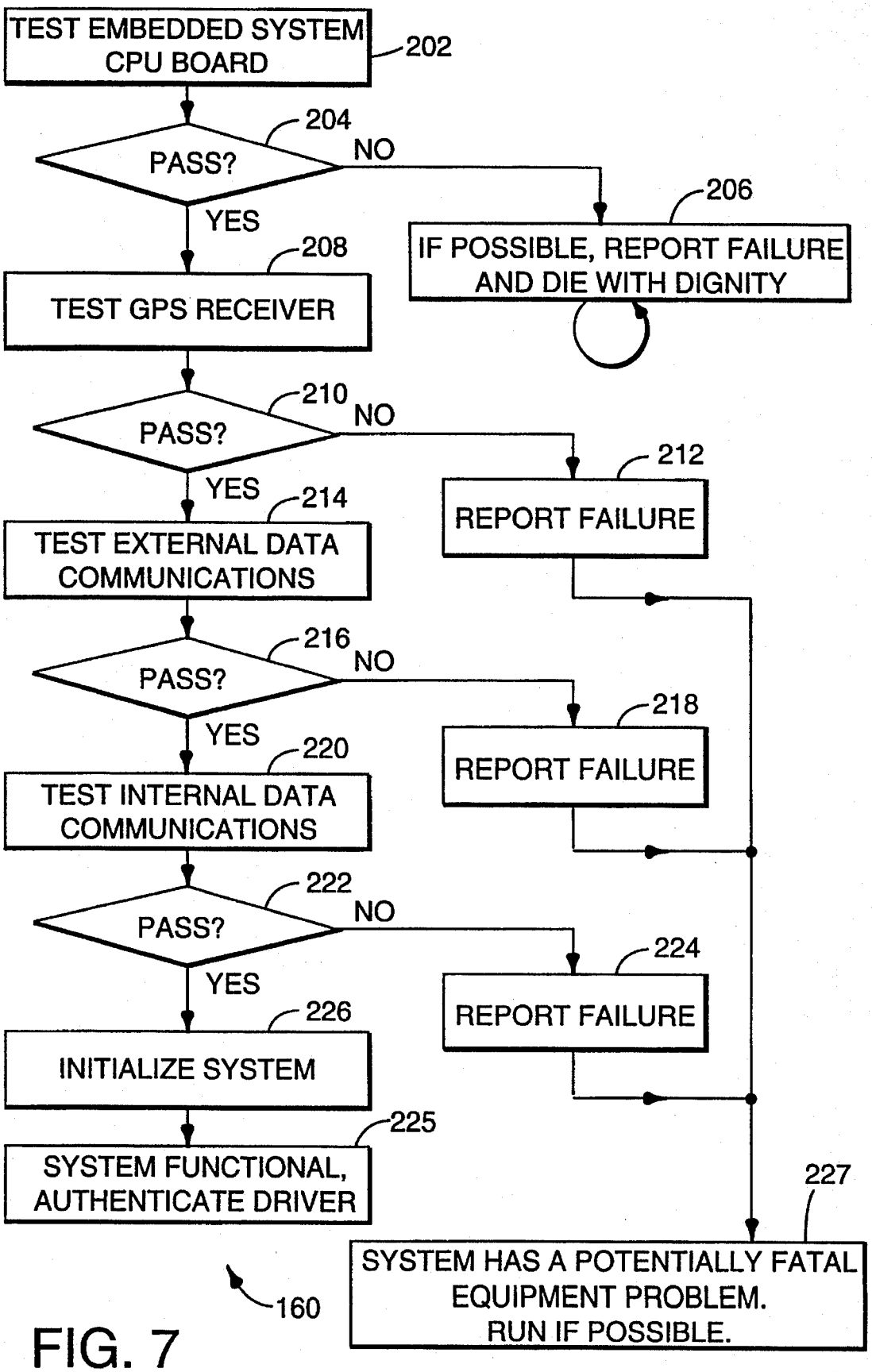
FIG. 7 shows a self-test and initialization system in more detail.
Figure 9:
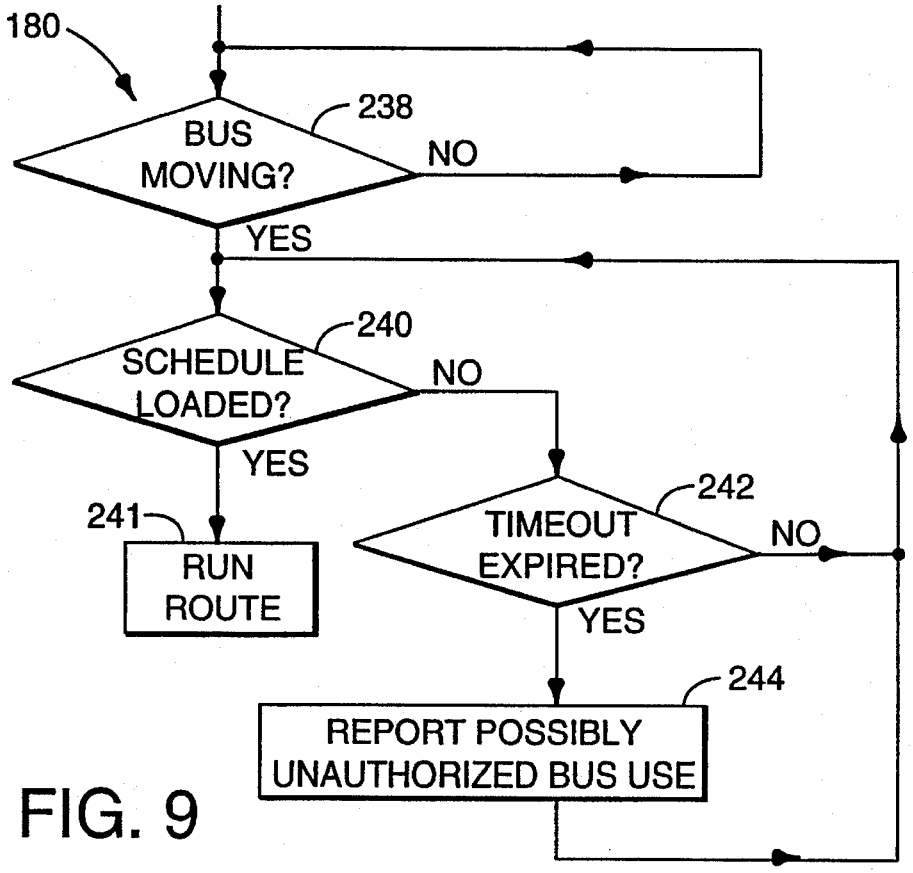
FIG. 9 shows a load route schedule step in more detail.
Figure 10:
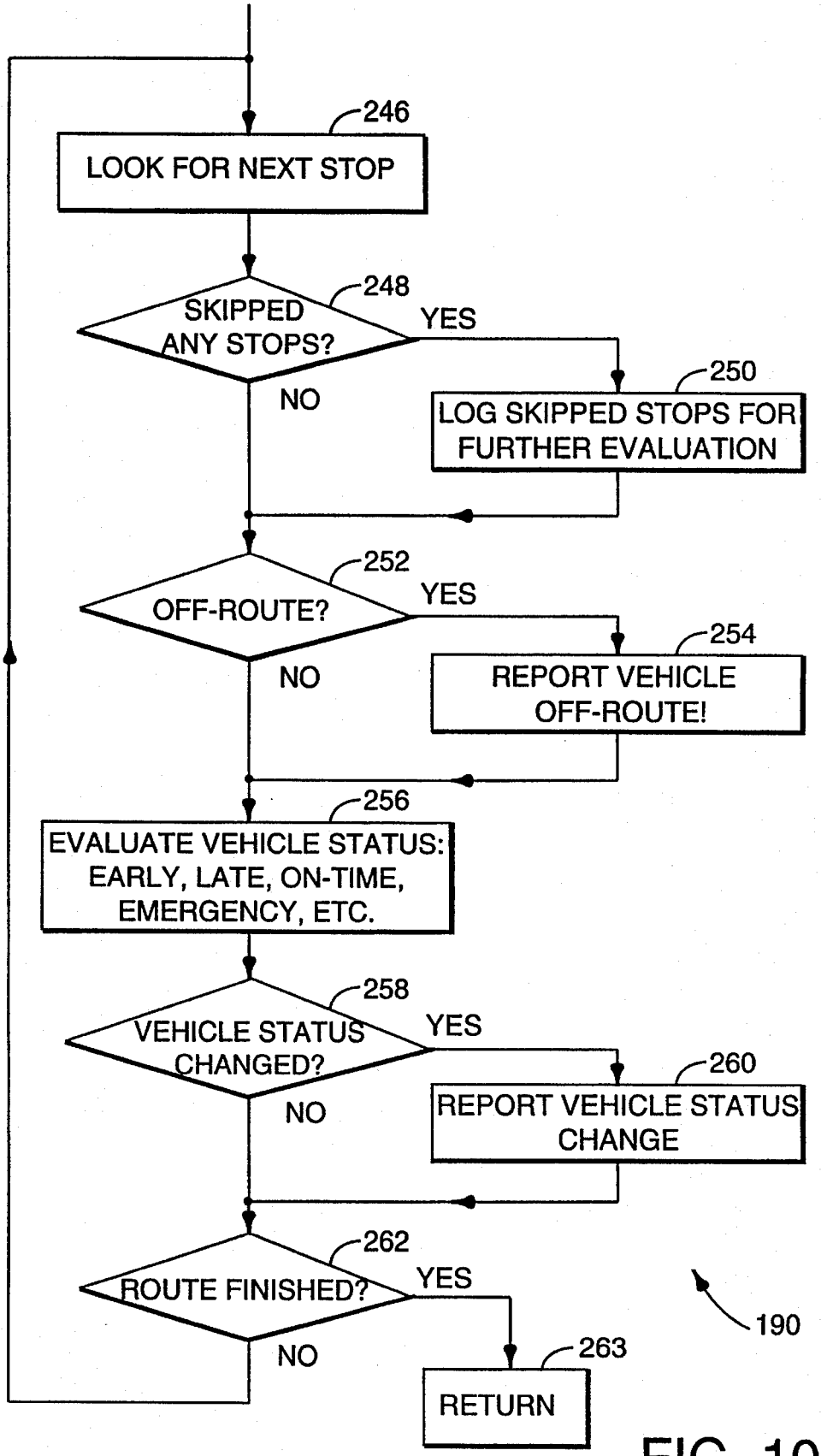
FIG. 10 shows a run route step in more detail.
Figure 11:
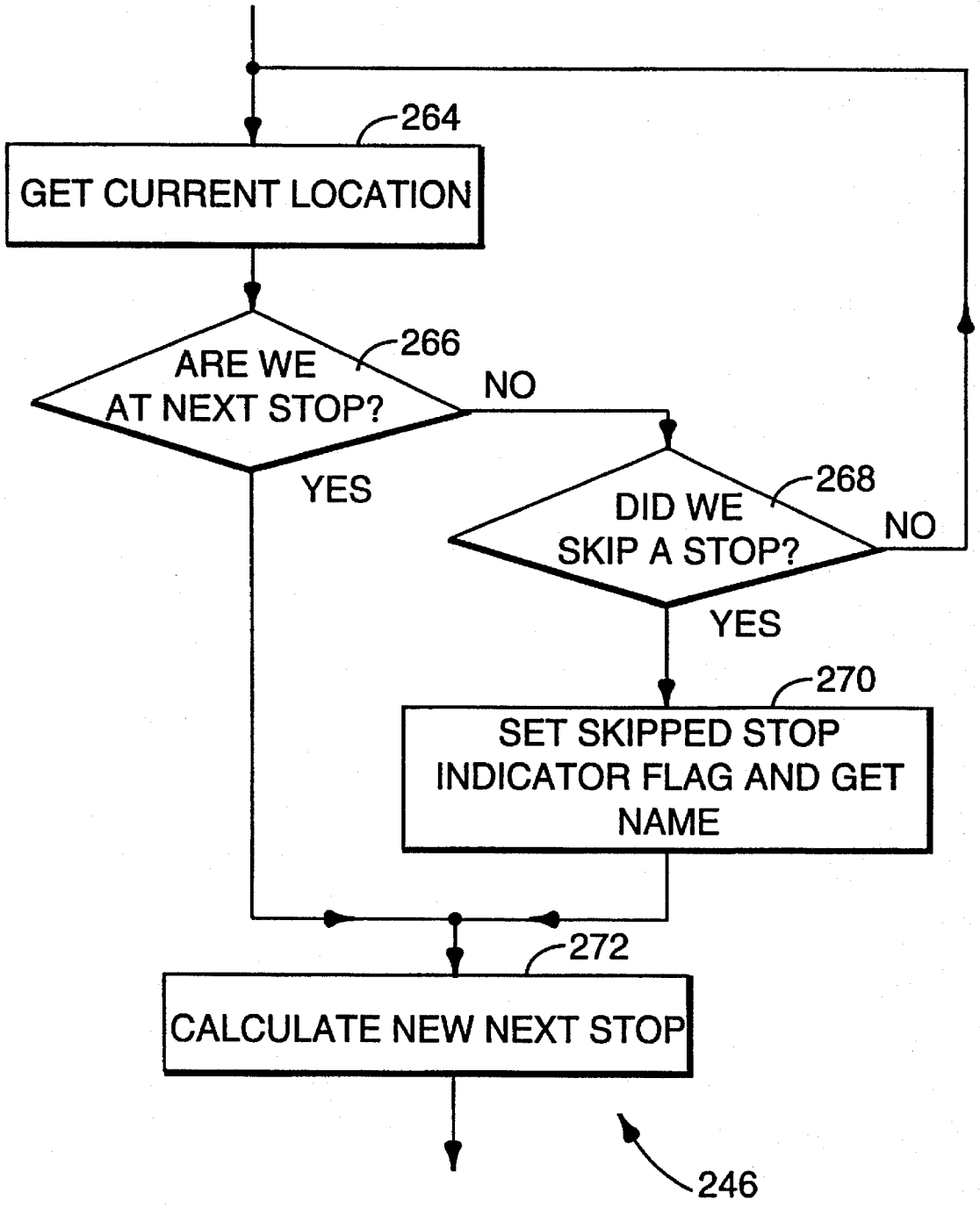
FIG. 11 shows a method of looking for the next stop.

FIG. 7 shows the self-test and initialization step 160 in more detail. FIG. 9 shows the driver authorization step 170 in more detail. FIG. 10 shows the load route schedule step 180 in more detail. FIG. 11 shows the run route step 190 in more detail.

FIG. 7 shows the self test and initialization method of the invention. The process starts at step 202 to test the embedded system CPU board. The process then determines whether the system has passed in step 204 and, if it has not, reports a failure in step 206. If the embedded system board has passed, the process flows to step 208 to test the GPS receiver. If the GPS receiver has passed in step 210, the process continues to test the external data communications in step 214. If the GPS receiver does not pass the test in step 210, the process reports the failure in step 212 and the process flows to step 227 to try to run without the failed piece of equipment in step 227. In step 216, if the external data communications has not passed, a failure is reported in step 218 and, again, the system tries to run with the failed equipment in step 227. In step 220, the internal data communications are checked and if they do not pass in step 222, the process flows to report a failure in step 224. After reporting the failure, the process flows to step 227 to attempt to run with the fatal system problem. In step 226, the system is initialized and the process flows to step 225 to authenticate the driver.

Figure 8:
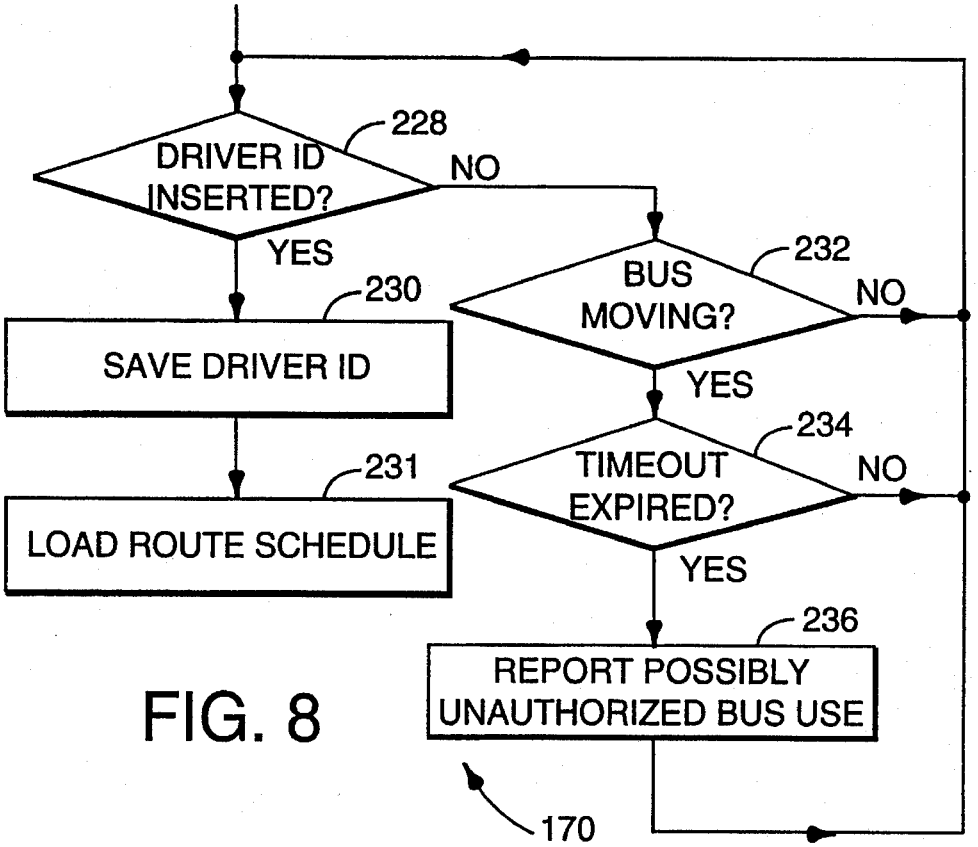
FIG. 8 shows a driver authorization step in more detail.

FIG. 8 shows the driver authorization process of the invention. The process flows to step 228 to determine whether a driver ID has been inserted. The driver ID may be in the form of a Datakey data transfer device or other code input method. If it has not, the process flows to step 232 to determine if the bus is moving. If it is not moving, the process returns to step 228 to determine whether a driver ID is inserted. If the bus is moving, a time out step 234 is initiated to allow a certain amount of time for maintenance people or others to move the bus. If the time has not expired, the process flows back to 228 and loops until the time has expired. Once the time has expired, the process flows to 236 to report a possible unauthorized bus use. The process then flows to step 228. If the driver ID is inserted at any time that step 228 is executed, the process flows to step 230 to save the driver ID and then flows to step 231 to determine if a schedule is available.

FIG. 9 shows the method of testing whether the route schedule is present. The process first checks whether the bus is moving in step 238. If it is not moving, it loops back on itself. If the bus is moving, the process determines whether the schedule is loaded in step 240. If the schedule has not been loaded, the process flows to step 242 to determine whether, once again, the bus is being moved for maintenance purposes. If, in step 242, the bus moving time has not expired, the process loops onto step 242 until permitted moving time has expired. If the time allowed for maintenance movement has expired without a schedule being loaded, the process flows to block 244 to report possibly unauthorized bus use. Once the schedule has been loaded, the process then flows to step 241 to run the route.

FIG. 10 shows the method of the invention for running a vehicle route. The process is a monitoring process that occurs in a serial sequential fashion and also in a parallel concurrent fashion. The various steps and checks of the invention to run a route may occur in any logical order depending on the particular implementation. The process starts at step 246 to look for the next stop or, if it is the first stop, to look for the initial stop. The process of looking for the next stop is described in more detail in FIG. 11. After looking for the next stop in 246, the process flows to step 248 to determine whether any of the stops were skipped. In this context a "skipped" stop is not one that the bus drives past, but rather one that the bus has passed without the location sensor ever indicating the coordinates of that stop. This might happen for a variety of reasons. For example, road work may require the bus to follow a detour around the stop. A stop may also be skipped because incorrect coordinates were entered. Thus the bus was never at the coordinates in the database because it was not supposed to be there. Alternatively, in a system that relies solely on GPS and does not have a dead reckoning, inertial, or other backup, some stops will be skipped because of local terrain that blocks the reception of a GPS signal. Thus the stops are skipped because the system is incapable of determining that the bus is at that location. The process logs the skipped stops in step 250. This is provides a history of stops that were skipped in order to determine the reasons that they were skipped.

The process then flows to step 252 to determine whether the vehicle is off route. If it is off route, the process flows to step 254 to report that the vehicle is off route. If it is not off route, the process flows to step 256 to evaluate the vehicle status. This includes whether it is early, late, on time or in an emergency condition. In step 258, the system determines if the vehicle status has changed since the previous evaluation. If so, the process flows to step 260 to report the new vehicle status. If the vehicle status has not changed the process flows to step 262 to check whether the route was finished. If the route was not finished the process loops back to step 246 to process the next stop. If the route has been finished, the process returns to the calling routine in step 263.

FIG. 11 shows the method of looking for the next stop. The process starts at step 264 where the current location is obtained from the location sensor. The process then flows to step 266 to determine whether or not the bus is at the next stop. If it is not at the next stop, the process flows to step 268 to determine whether it skipped a stop. If it did not skip a stop, the process returns to step 264 to monitor the current location and to determine whether it is at the next stop. If at step 268, it did skip a stop, the process flows to step 270 to set the skipped stop indicator flag and determine the identity of the skipped stop. The process then flows to step 272 to calculate the new next stop and continues the process of FIG. 10. If, in step 266, the bus is at the next stop, the process flows directly to step 272 to calculate the new next stop.

Figure 12:
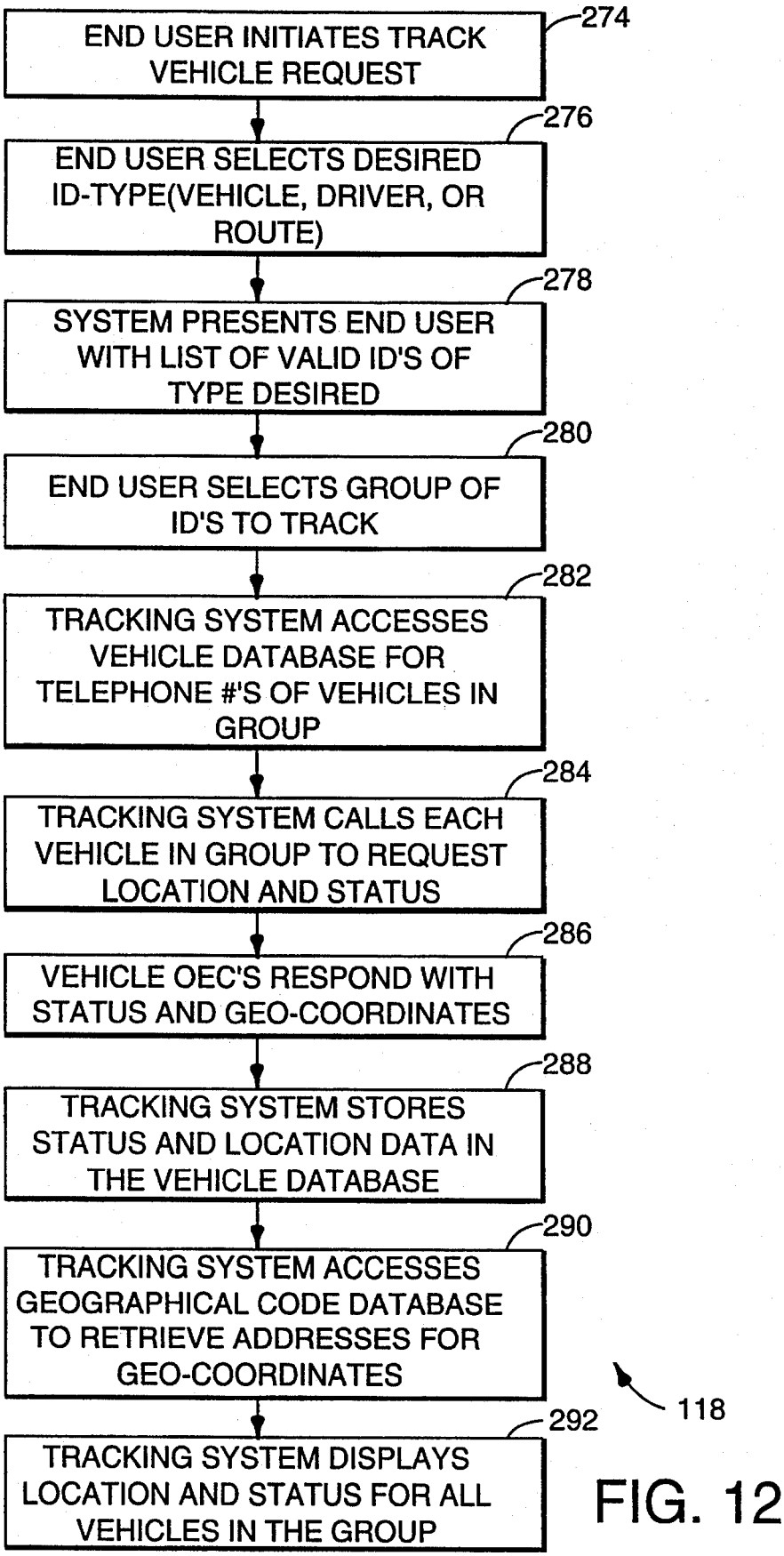
FIG. 12 shows the vehicle tracking method of the invention.

FIG. 12 shows the vehicle tracking method of the invention. The vehicle tracking method of the invention is used by the dispatch center to determine the vehicle status and vehicle position en route. The process starts at step 274 to where the system operator initiates a track vehicle request. The process flows to step 276 where the operator selects the desired ID type. An ID can represent, among other things, a driver identification or a route identification. The process then flows to step 278 where the system presents the operator with list of valid ID's of the type desired. The process then flows to step 280 where the operator selects a group of Id's to track. The group may include one or a plurality of ID's. The process then flows to step 282 to access the vehicle database for the telephone numbers of the vehicles in the group. The process then flows to step 284 to call each vehicle in their request group to determine its location and status. The process then flows to step 286 where the vehicles respond with their status and location. The process then flows to step 288 where the system stores the status and location data in the vehicle database. The process then flows to step 290 to access the geographic code data base and retrieve the addresses for the geographic coordinates. The process then flows to step 292 to display the location and status of all of the vehicles in the selected group on the tracking system display.

Figure 13:
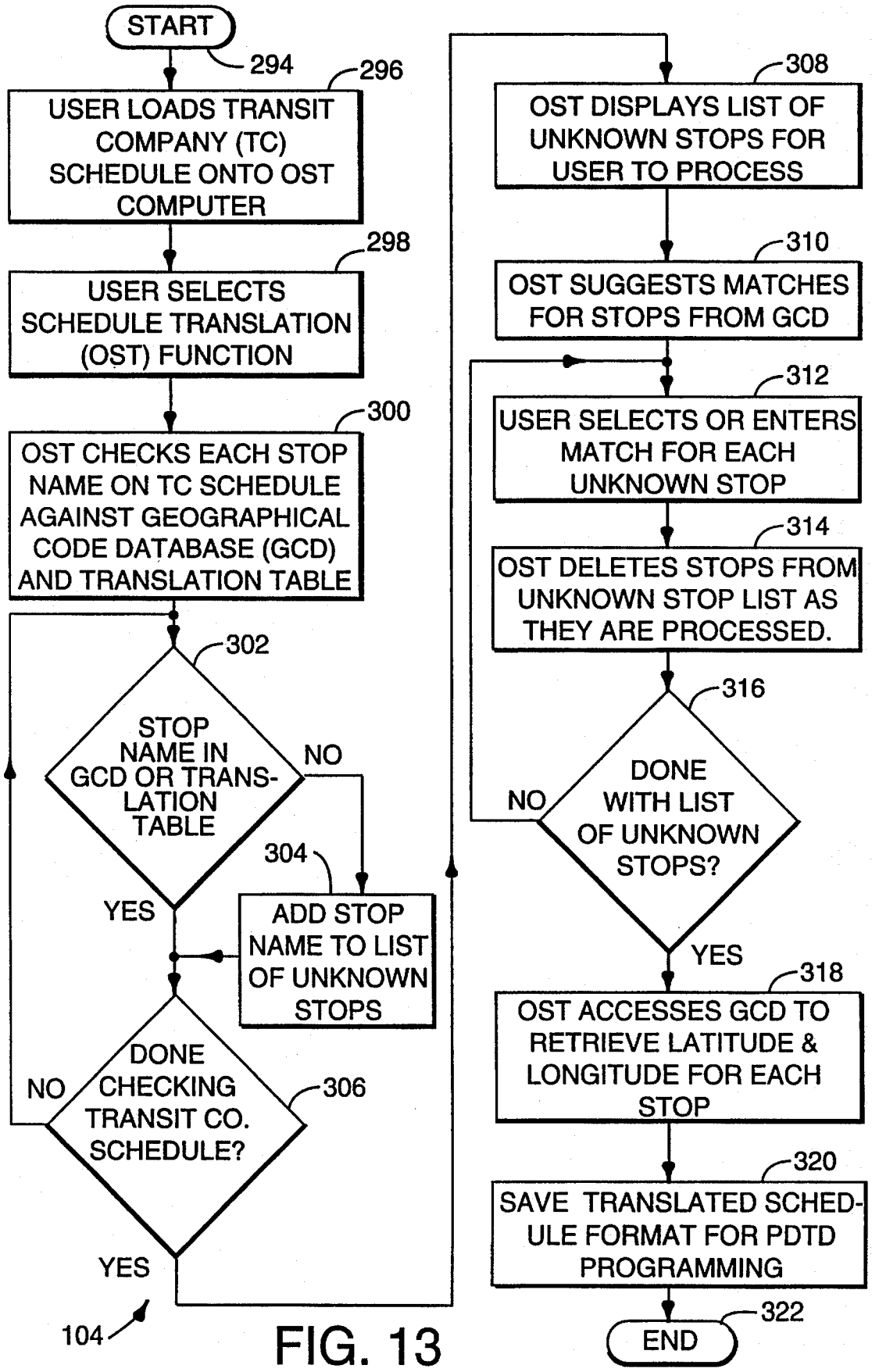
FIG. 13 shows the method of the invention used to translate a vehicle schedule unloaded into a vehicle embedded system controller.

FIG. 13 shows the method used to translate a vehicle schedule from the format used by the transit company's computer to that used in the invention. The process starts at step 294 and proceeds to step 296 where the user causes the translation system computer to load the transit company schedule. The process flows to step 298 where the user selects the translation to begin. The process then flows to step 300 where the dispatch computer checks each stop name on the schedule against geographical locations and a translation table. The process then flows to step 302 to determine whether the stop name is in the database or translation table. If it is not, the stop is added to a list of unknown stops 304. If it is in the data base, the process flows to step 306 to determine whether all of the stops on the schedule have been checked. If the schedule has not all been checked the process continues to loop to step 302 to check additional stops. Once the entire schedule has been checked, the system proceeds to step 308 to display a list of unknown stops for the user to process. The process then flows to step 310 to suggest matches for the unknown stops from the current database. The process then flows to step 312 where the user selects a match for each unknown stop. The process then flows to step 314 to delete the stops from the unknown stop list. The process then flows to step 316 to determine whether all of the unknown stops have been processed. If they have not, the process loops to step 312. If all the unknown stops have been processed, the process flows to step 318 to access the database to retrieve latitude and longitude for each stop. The process flows to step 320 to save the translated schedule format for loading into the portable data transfer device. The process ends in step 322.

Figure 14:
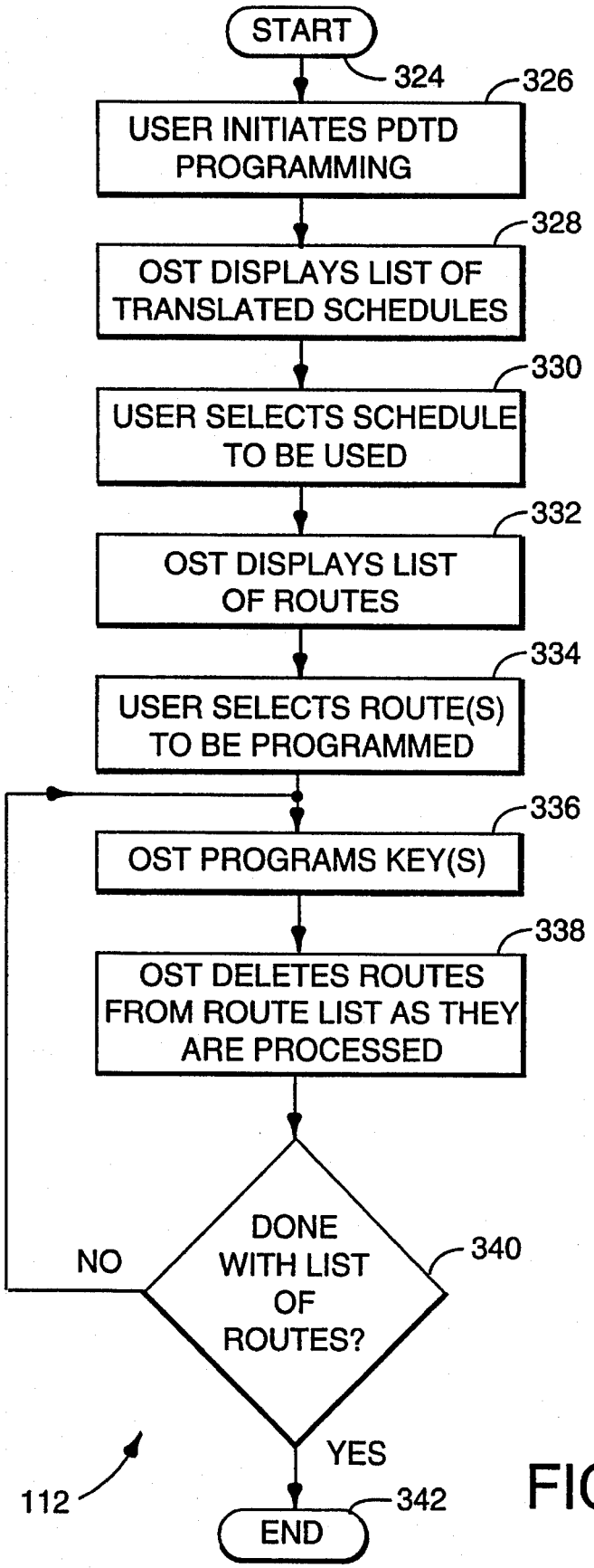
FIG. 14 shows the portable data transfer device programming method of the invention.

FIG. 14 shows the portable data transfer device programming method of the invention. The process starts at step 324 and proceeds to step 326 to initiate the portable data transfer device programming. The process then flows to step 328 to display the list of translated schedules. The user selects the schedule to be used in step 330. The system displays lists of routes included in the selected schedules in step 332 and the user selects a route to be programmed into the portable data transfer device in step 334. The system programs the portable data transfer device in step 336 and deletes the routes from the route list as they are processed in step 338. In step 340 the system checks to determine if all selected routes have been transferred to portable data transfer devices. If not, the process loops to step 336. If it is done, the process flows to step 342 to end the programming of the portable data transfer devices.

A demonstration prototype consisting of tracking a vehicle to a schedule using GPS was created in early 1993. The prototype hardware included a Dell 325N notebook computer and a Rockwell NavCore V GPS Development Kit. The prototype software was developed at 3M using Borland C v3.1 and Rockwell-provided communications and GPS drivers. This prototype performs all basic tracking functions and simulates an Opticom emitter. External data communications and the vehicle data network were not implemented.

What is claimed is:

1. A vehicle tracking system comprising:

vehicle position identifying means for determining a position of a tracked vehicle and for producing therefrom vehicle position information;

vehicle schedule means for providing vehicle schedule information, wherein the vehicle schedule information includes a vehicle route comprised of a plurality of vehicle stops and a corresponding plurality of scheduled arrival times;

controller means for receiving the vehicle schedule information and for receiving the vehicle position information, and further for comparing the vehicle position information with the vehicle schedule information and for producing therefrom vehicle status information regarding whether the tracked vehicle is on schedule, whether the tracked vehicle is off the vehicle route, and whether the tracked vehicle skipped any of the vehicle stops; and traffic signal preemption means, connected to receive the vehicle status information, for requesting preemption of traffic signals based on the vehicle status information.

2. The system of claim 1 further including a vehicle data network adapted to provide vehicle passenger information to the controller means.

3. The system of claim 2 wherein the vehicle data network is further adapted to provide vehicle mechanical status information.

4. The system of claim 2 wherein the vehicle data network is further adapted to provide vehicle emergency status information.

5. The system of claim 1 further including means for reporting the vehicle status information to a vehicle dispatch center.

6. The system of claim 5 wherein the vehicle dispatch center monitors the vehicle status information received from each of a plurality of tracked vehicles.

7. The system of claim 6 wherein the vehicle dispatch center further analyzes the vehicle status information to determine whether the vehicle schedule information for any of the plurality of tracked vehicles should be modified.

8. The system of claim 1 wherein the vehicle schedule information is input via a portable data transfer device.

9. The system of claim 1 wherein the vehicle position identifying means receives signals from a Global Positioning System and determines therefrom the position of the tracked vehicle.

10. The system of claim 1 further including a geographic information system database for converting address, intersection or feature name information provided by the vehicle schedule information into corresponding latitude and longitude information.

11. The system of claim 1 wherein the controller means receives a driver's identification information and determines whether the driver is an authorized driver of the tracked vehicle.

12. The system of claim 1 further including a driver interface to display the vehicle status information.

* * * * *

UNITED STATES PATENT AND TRADEMARK OFFICE

CERTIFICATE OF CORRECTION

PATENT NO. : 5,602,739
DATED : February 11, 1997
INVENTOR(S) : Jeffrey D. Haagenstad, et. al.

It is certified that error appears in the above-identified patent and that said Letters Patent is hereby corrected as shown below:

Title page, item ]57] ABSTRACT, line 7, delete "-" after the word "may".

Column 3, line 24, delete "aim" and insert therefore –also--.

Column 7, line 57, delete "is".

Signed and Sealed this

Thirteenth Day of January, 1998

Bruce Lehman

BRUCE LEHMAN

*Commissioner of Patents and Trademarks*

*Attest:*

*Attesting Officer*